US006053597A

United States Patent [19]

Hirota

[11] Patent Number: 6,053,597

[45] Date of Patent: Apr. 25, 2000

[54] INK JET RECORDING APPARATUS AND METHOD FOR AUTOMATICALLY CHANGING RECORDING OPERATION MODE WHEN INTERCHANGEABLE RECORDING HEAD UNIT IS REPLACED

[75] Inventor: Tetsuro Hirota, Hadano, Japan

[73] Assignee: Ricoh Company, Ltd., Tokyo, Japan

[21] Appl. No.: 08/864,302

[22] Filed: May 28, 1997

[30] Foreign Application Priority Data

May 30, 1996 [JP] Japan ..... 8-136953

[51] Int. Cl.[7] ..... B41J 29/393

[52] U.S. Cl. ..... 347/19; 399/12; 235/462.01; 235/462.13

[58] Field of Search ..... 347/9, 14, 19; 399/12; 400/175; 235/462.01, 462.13, 462.14, 462.43, 479

[56] References Cited

U.S. PATENT DOCUMENTS

| | | | |
|---|---|---|---|
| 4,930,915 | 6/1990 | Kikuchi et al. | 400/175 |
| 5,033,887 | 7/1991 | Bauerle | 400/175 |
| 5,235,351 | 8/1993 | Koizumi | 347/19 |
| 5,265,315 | 11/1993 | Hoisington et al. | 347/71 |

*Primary Examiner*—William Royer
*Assistant Examiner*—William A. Noe
*Attorney, Agent, or Firm*—Cooper & Dunham LLP

[57] ABSTRACT

An ink jet recording apparatus capable of automatically changing a mode of recording operation to fit to a newly installed recording head unit, when at least one interchangeable recording head unit is replaced. The ink jet recording apparatus includes an interchangeable recording head unit, which has an ink jet head and an ink cartridge and which also includes an information retaining plate, mounted on an exterior surface of the recording head unit, for retaining information of recording characteristics of the recording head unit, including characteristics of the number of ink jet nozzles, recording density, and ink discharging efficiency; a reading device for reading information retained on the information retaining plate mounted on the recording head unit; and a controller for instructing the reading device to read an information retaining plate when at least one of the recording head units is replaced and for performing, in accordance with the information of the recording characteristics of the interchangeable recording head unit, at least one function for setting up a mode of recording operation of the novel ink jet recording apparatus and transmitting information to an external host system.

24 Claims, 10 Drawing Sheets

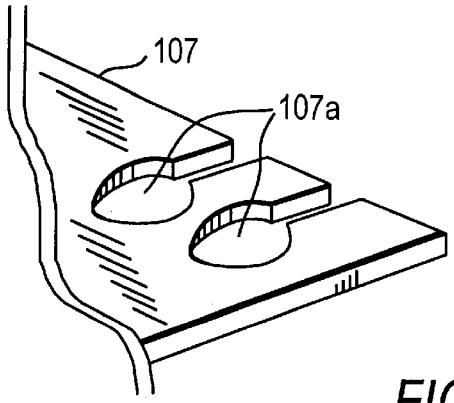
FIG. 13
FIG. 14
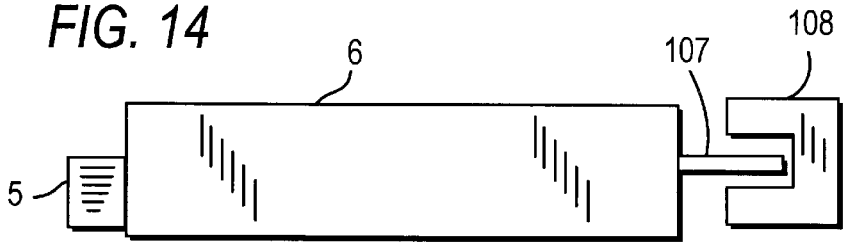
FIG. 15
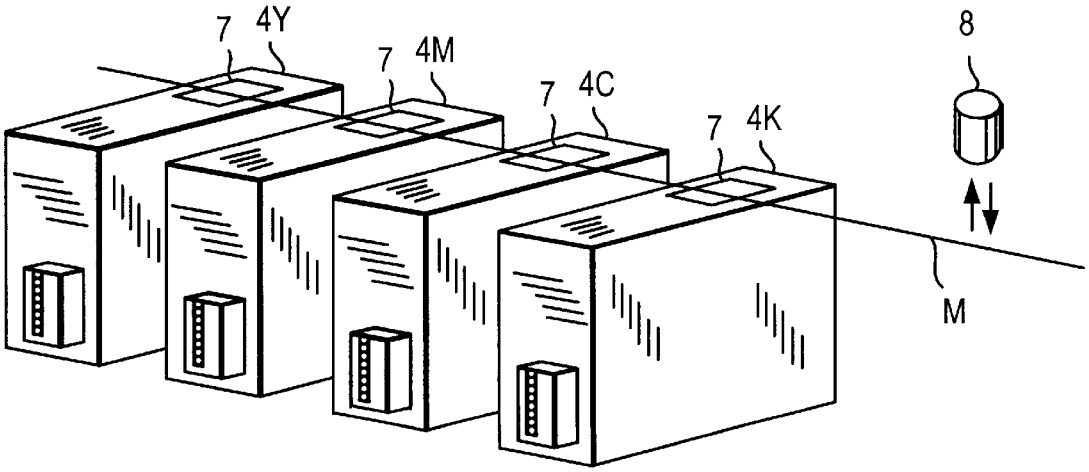

INK JET RECORDING APPARATUS AND METHOD FOR AUTOMATICALLY CHANGING RECORDING OPERATION MODE WHEN INTERCHANGEABLE RECORDING HEAD UNIT IS REPLACED

BACKGROUND OF THE INVENTION

1. Field of the Invention

This invention relates to an ink jet recording apparatus, and more particularly to an ink jet recording apparatus having a function for automatically changing a mode of recording operation to fit to a newly installed interchangeable recording head unit in an extremely simple and low cost structure.

This invention also relates to an interchangeable recording head unit.

This invention also relates to a method of performing the above-mentioned function.

2. Discussion of the Background

Ink jet type recording has been widely adapted to various types of data outputting apparatus, such as a printer connected to a digital processing system, a facsimile apparatus, a copying apparatus, and so forth. A reason is that ink jet recording apparatus produces vibrations and acoustic noises both at minimal levels during a recording operation, in comparison with other type of data outputting apparatus. Another reason, which is considered as an increasingly important factor for data outputting apparatus by the recent demand, is that the ink jet recording apparatus can easily handle colors.

The ink jet recording apparatus has a recording head unit which includes an ink cartridge and an ink jet head operated by an actuating element, such as, a piezoelectric element, an exothermic reaction resisting element, or the like. By driving such an actuating element in accordance with a signal to be recorded, ink in the ink cartridge is discharged through nozzles and falls onto a recording medium. As a result, an image is recorded on a recording medium.

Recording head units for use with a particular ink jet recording apparatus are provided as combinations of an ink cartridge and an ink jet head, and are interchangeable with each other in the apparatus. This type of recording head unit (i.e., interchangeable) has been developed in order to help users in the case, for example, when an amount of ink in the ink cartridge remaining is small, or when an image quality deteriorates owing to an abnormal operation of the ink jet head.

When the above-mentioned interchangeable recording head unit is replaced in the recording apparatus at the user's convenience, the replacement recording head unit may have recording characteristics, such as number of ink jet nozzles, recording density, and also ink discharging efficiency, which differ from the previously installed recording head unit. Particularly, the ink discharging efficiency may be variable due to the fabrication dispersion when the recording head units are manufactured. In this case, the background ink jet recording apparatus may reduce its image quality level. In order to avoid this problem and to assure the quality performance, two countermeasures are required. One countermeasure is to reduce the variation of ink discharging efficiency to the point where it does not create a problem of image quality deterioration. This countermeasure can be achieved by selecting a recording head unit which has an ink discharging efficiency within a predetermined range. The other countermeasure is that the ink jet recording apparatus is provided with a function for detecting differences of ink jet head characteristics and for accordingly changing a mode of recording operation.

In addition, in some cases, a recording head unit may consist of a ink jet head, and an ink cartridge may be provided separately from the recording head unit. This type of recording head unit has also been made interchangeable. The reason is that a function of an interchangeable recording head unit is important for users, particularly, when the user desires to switch recording head units from one to the other in order to change a mode of recording operation, such as, a full-color recording or a black and white recording, a high recording density or a low recording density, and so forth.

The ink jet recording apparatus disclosed in the Japanese Laid Open Patent Application 61-197247 (1986) has a recording head unit which includes a head driving voltage setting circuit in an electrical interface circuit board of the recording head unit.

However, in this case, the interface circuit becomes a relatively complex and high cost structure. In addition, a procedure of setting a head driving voltage is highly complicated.

Presently, there is no ink jet recording apparatus which has a function of automatically changing a mode of recording operations to fit to a newly installed recording head unit in an extremely simple and low cost structure.

SUMMARY OF THE INVENTION

Accordingly, an object of the present invention is to provide a novel ink jet recording apparatus which is capable of automatically changing a mode of recording operation to fit to a newly installed recording head unit in an extremely simple and low cost structure.

To achieve the above-mentioned object, a novel ink jet recording apparatus includes an interchangeable recording head unit which comprises a combination of an ink jet head and an ink cartridge and which includes a machine-readable array of indicia (such as an information retaining plate), mounted on an exterior surface of the recording head unit, for retaining information of recording characteristics of the recording head unit, including the following characteristics: number of ink jet nozzles, recording density, and ink discharging efficiency; a reading device for reading information retained on the information retaining plate mounted on the recording head unit; and a controller for instructing the reading device to read an information retaining plate when at least one of the recording head units is replaced and for performing, in accordance with the information of the recording characteristics of a newly installed interchangeable recording head unit, at least one function for setting a mode of recording operation of the novel ink jet recording apparatus and transmitting information to an external host system.

In a particular embodiment of the above-mentioned ink jet recording apparatus, the information retaining plate is a bar-code label.

Further, in embodiments of the above-mentioned ink jet recording apparatus, the reading device can be a reflection type optical sensor.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 13 is an enlarged view of an information retaining plate of the modified interchangeable recording head unit shown in FIG. 12;

FIG. 14 is a schematic illustration showing a reading device for reading the information retaining plate shown in FIG. 13; and FIG. 15 is a schematic perspective view illustrating how a reading device reads a plurality of information retaining labels in a single scanning operation when the same plurality of interchangeable recording head units are installed.

DESCRIPTION OF THE PREFERRED EMBODIMENTS

Figure 1:
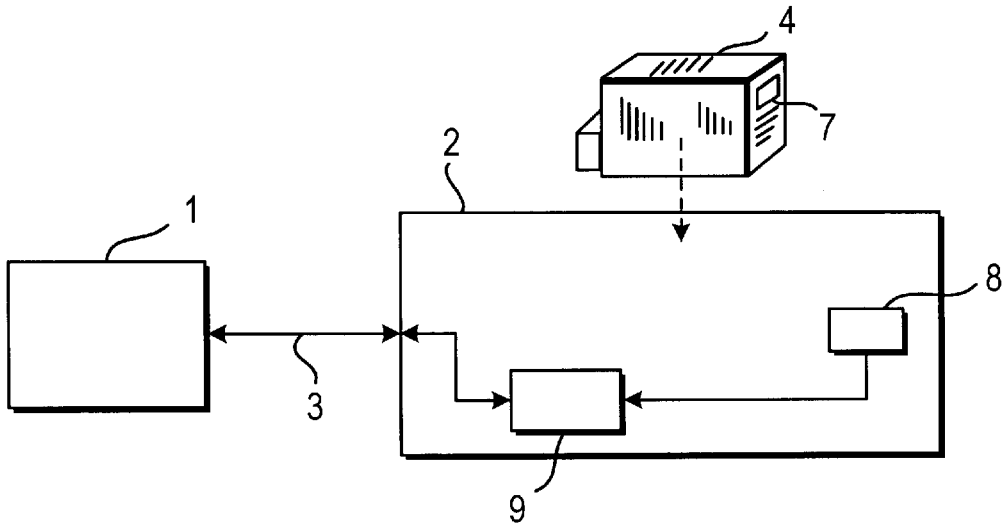
FIG. 1 is a schematic block diagram of an exemplary data processing system including an exemplary embodiment of the novel ink jet recording apparatus of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, the data processing system shown in FIG. 1 includes a host 1 represented by, for example, a personal computer or the like and a novel ink jet recording apparatus 2 according to the present invention. The host 1 and the novel ink jet recording apparatus 2 are connected via an interface cable 3.

Figure 2:
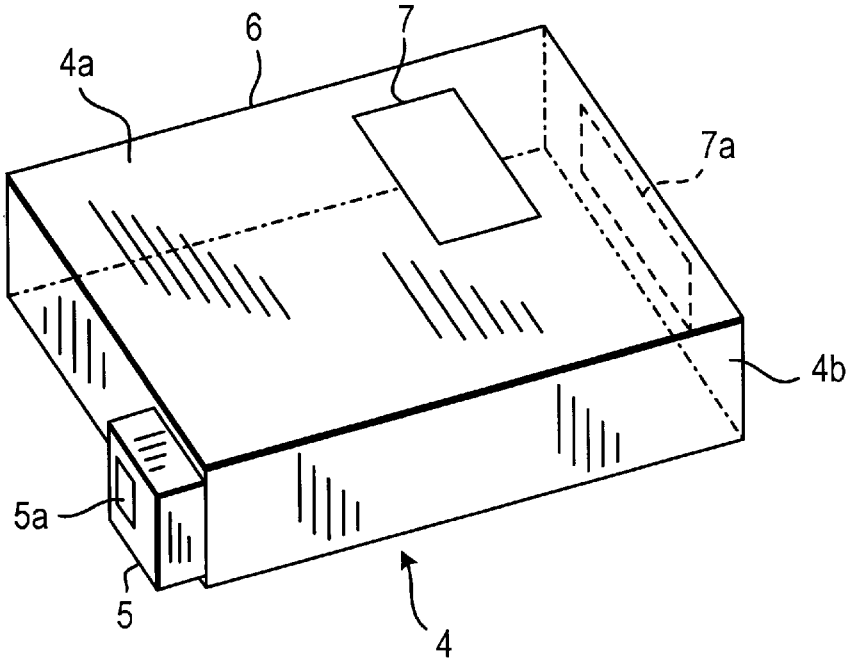
FIG. 2 is a schematic perspective view of an interchangeable recording head unit of the ink jet recording apparatus shown in FIG. 1.

The novel ink jet recording apparatus 2 is capable of having an interchangeable recording head unit 4 of which details are shown in FIG. 2. The recording head unit 4 has an integral-type form of an ink jet head 5 and an ink cartridge 6 for supplying ink to the ink jet head 5, as shown in FIG. 2.

The ink jet head 5, a multiple-nozzle type ink jet head having a plurality of nozzles, may in itself be a conventional ink jet head, i.e. of known structure and operation, and may include an actuator device of known device such as a piezoelectric element, for example. The piezoelectric element of the ink jet head 5 is driven in accordance with information to be recorded so as to provide pressure to a pressure liquid chamber via a vibration plate and in accordance with the information to be recorded. Then, ink in the pressure liquid chamber is discharged from nozzles 5*a* which are connected to the pressure liquid chamber.

The ink jet head unit 4 further includes machine-readable array of indicia in the form of a bar-code label 7, mounted on a top-side exterior surface 4*a* thereof, for retaining information of characteristics with respect to the ink jet head unit 4 in a form of a plurality of bar-codes. The bar-codes of the bar-code label 7 represent information of, for example, the number of nozzles, recording density, ink discharging efficiency, and so on, of this particular head unit.

The bar-code label 7 may be fixed on a rear-side exterior surface 4*b* of the ink jet head unit 4 as shown by the dotted rectangle square 7*a* in FIG. 2, instead of being fixed on the top-side exterior surface 4*a*. Further, the bar-code label 7 may be placed at other regions, such as bottom-side, left-side, or right-side exterior surfaces of the ink jet head unit 4. More generally speaking, the position of the bar-code label 7 may be defined as a region where a reading unit (later explained) of the novel ink jet recording apparatus 2 can access (view) the label to read bar-codes held by the bar-code label 7. Alternatively, the top-side exterior surface 4*a* (or another exterior surface of the head unit) itself may be used as an information retaining plate by directly printing bar-codes thereon, without having the bar-code label 7 to be stuck on the top-side exterior surface 4*a*, for example.

The novel ink jet recording apparatus 2 further includes a reflection type optical sensor 8 and a control circuit board 9. The reflection type optical sensor 8 reads bar-codes of the bar-code label 7, and in itself may be a known conventional type of sensor for reading bar-codes. The control circuit board 9 controls the entire system of the ink jet recording apparatus 2, including characteristics of the present invention in which various parameters, such as head driving voltage, carriage scanning speed, paper feed increment, and so forth, are determined in accordance with the read information (i.e., the information of ink jet head characteristics read by the reflection type optical sensor 8). Also, the control circuit board 9 controls transferring the read information of the ink jet head characteristics to the host 1.

Next, mechanical operation of the novel ink jet recording apparatus 2 is explained with reference to FIG. 3. The novel ink jet recording apparatus 2 includes a pair of guide shafts 11 and 12 supported by a pair of side plates (not shown) at left and right ends, respectively, inside the ink jet recording apparatus 2. The novel ink jet recording apparatus 2 further includes a carriage 14, movably supported by the pair of guide shafts 11 and 12, for holding a pair of recording head units 4. Further, the novel ink jet recording apparatus 2 includes a main scanning motor 15 mounted inside at one end of the ink jet recording apparatus 2, a driving pulley 16 secured on a rotary shaft of the main scanning motor 15, an idler pulley 17 mounted inside at the other end of the ink jet recording apparatus 2, and an endless wire 18 trained, with tension, around the driving pulley 16 and the idler pulley 17 and extending therebetween. The carriage 14, movable along the pair of guide shafts 11 and 12, is secured to the wire 18 so as to be moved by the wire 18 driven by the main scanning motor 15. By this arrangement, the pair of the recording head units 4 held by the carriage 14 can be caused to perform a main scanning motion by driving the main scanning motor 15.

Further, the novel ink jet recording apparatus 2 includes a sub-scanning motor 20, mounted at a rear end of the interior of the ink jet recording apparatus 2, for driving a set of gears 21 for transmitting rotational movement to a platen 22 holding a paper sheet 50. By this arrangement, the paper sheet 50 can be caused to be transferred (advanced) by driving the sub-scanning motor 20.

In the above-mentioned way, the novel ink jet recording apparatus 2 controls the movement of the recording head units 4 in the main scanning direction (arrows M, FIG. 4) and the paper sheet 50 in the sub-scanning direction (arrows S, FIG. 3), and, at the same time, controls discharging of ink from the nozzles of the recording head units 4 so that a desired image is recorded on the paper sheet 50.

Figure 3:
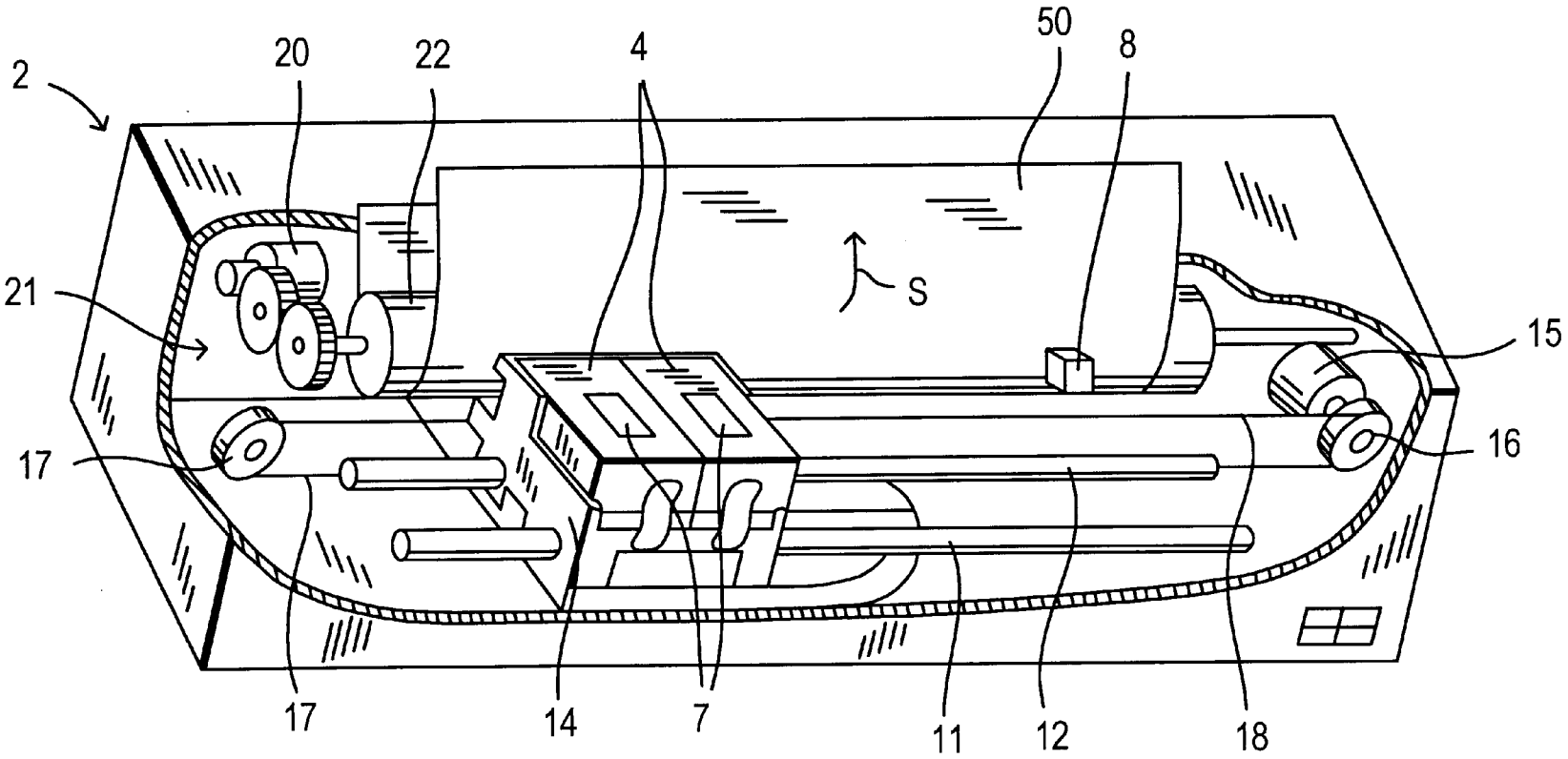
FIG. 3 is a schematic perspective view of the main structure of the novel ink jet recording apparatus shown in FIG. 1.
Figure 4:
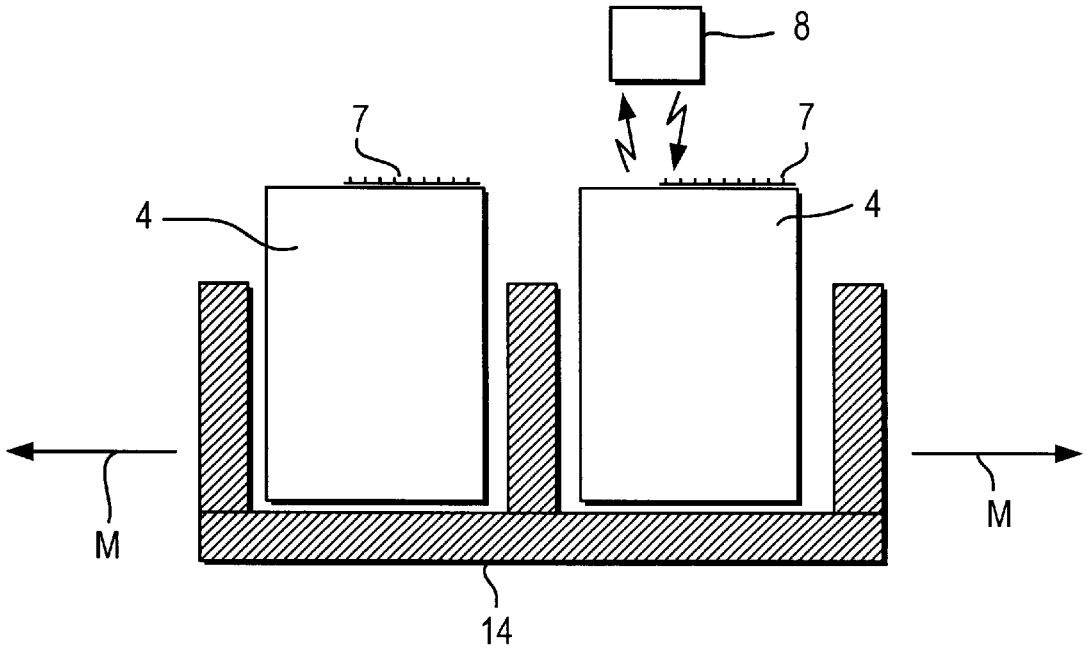
FIG. 4 is a schematic front view of a carriage having two interchangeable recording head units are mounted thereon.

As shown in FIGS. 3 and 4, the aforementioned reflection type optical sensor 8 is mounted at an upper side of the region where the carriage 14 scans in the directions indicated by arrows M. Thus, the novel ink jet recording apparatus 2 can read bar-codes of the bar-code label 7 fixed on the upper surface of the recording head units 4 installed on the moving carriage 14, through the reflection type optical sensor 8.

Figure 5:
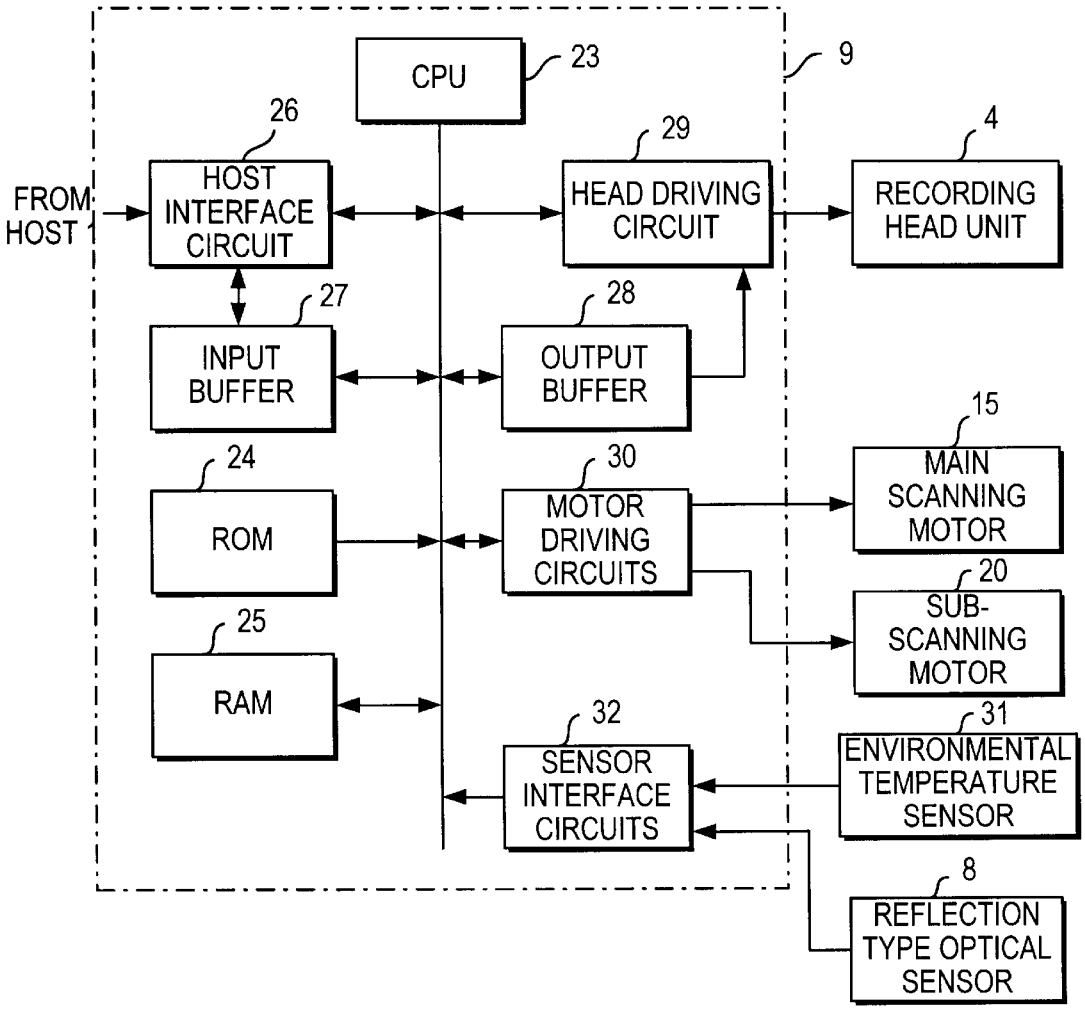
FIG. 5 is a block diagram of a controller for explaining a recording operation by the novel ink jet recording apparatus according to the present invention.

Next, a recording operation of the control circuit board 9 of the novel ink jet recording apparatus 2 is explained with reference to the block diagram shown in FIG. 5. The control circuit board 9 of the novel ink jet recording apparatus 2 includes a central processing unit (CPU) 23 for controlling the entire printer system, a ROM 24 for storing a system control program, and a RAM 25 for temporarily storing various data such as the bar-codes information read by the reflection type optical sensor 8, for example. The control circuit board 9 further includes a host interface circuit 26 for receiving recording data from and for sending status information to the host 1, and an input buffer 27 for storing the recording data sent from the host 1 via the host interface circuit 26. The control circuit board 9 further includes an output buffer 28 for storing data for driving the recording head units 4 in accordance with the recording data stored in the input buffer 27 and a head driving circuit 29 capable of varying the head driving voltage to drive the recording head units 4 in accordance with the data stored in the output buffer 28. The control circuit board 9 further includes motor driving circuits 30 for driving the main scanning motor 15 and the sub-scanning motor 20, respectively, and sensor interface circuits 32 for receiving various information, such as bar-code data from the reflection type optical sensor 8, information of environmental temperature, and so on. The information of environmental temperature is detected by an environmental temperature sensor 31 provided inside of the ink jet recording apparatus 2.

With the thus configured control circuit board 9, recording data sent from the host 1 are stored in the input buffer 27, via the host interface circuit 26, and transferred to the output buffer 28 after passing through a predetermined data processing procedure. Then, the head driving circuit 29 selectively drives the piezoelectric elements of the ink jet heads 5 of the recording head units 4 in accordance with the recording data stored in the output buffer 28. At the same time, the motor driving circuits 30 drive the main scanning motor 15 and the sub-scanning motor 20 so as to move the carriage 14 and the paper sheet 50, respectively. In this way, the control circuit board 9 of the novel ink jet recording apparatus 2 controls the recording operation.

Further, the control circuit board 9 controls the head driving circuit 29 to set the output head driving voltage at a predetermined value in accordance with information of the environmental temperature detected by the environmental temperature sensor 31 and the ink jet head characteristics read by the reflection type optical sensor 8 from the labels 7 of the head units.

Figure 6:
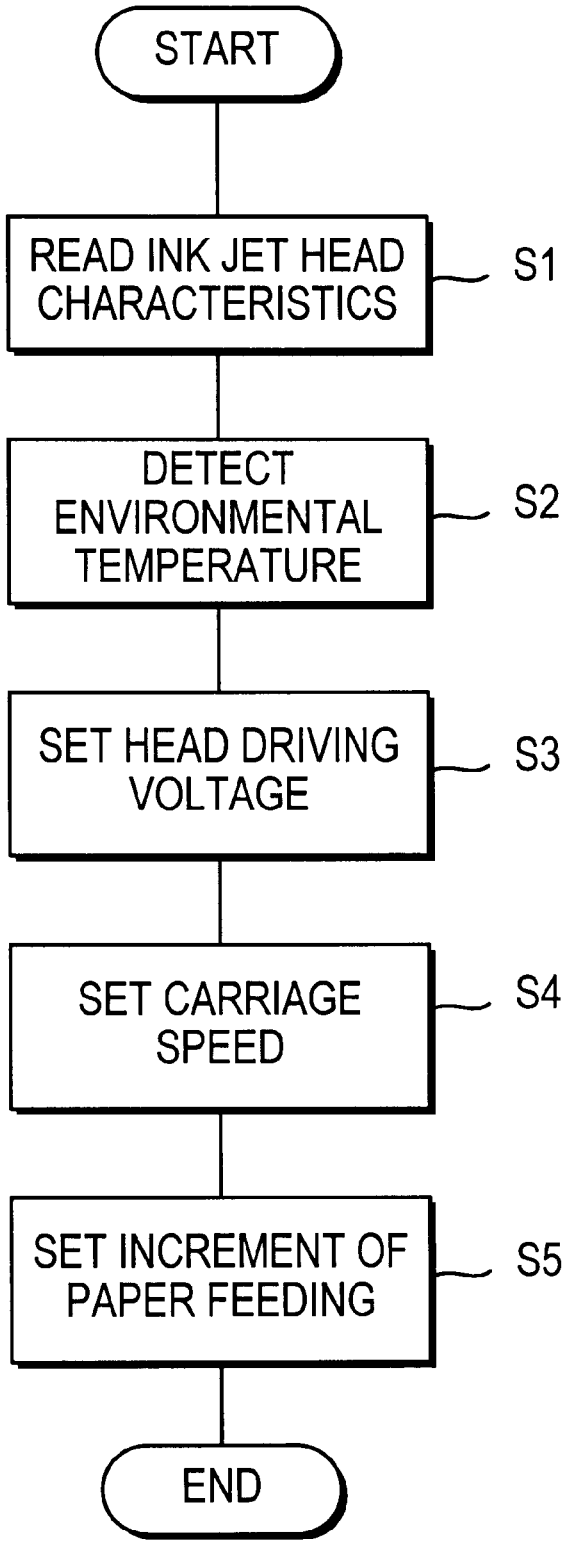
FIG. 6 is a flowchart for explaining a procedure for setting a mode of recording operation performed by the controller shown in FIG. 5.

Next, a procedure of resetting a mode of printing operations is explained with reference to the flowchart shown in FIG. 6. The control circuit board 9 resets a mode of printing operation at each time of a power-on, a replacement of the recording head unit 4, and an instruction by the host 1, in a manner as explained by the flowchart shown in FIG. 6.

During Step S1 in the above-mentioned flowchart, the CPU 23 of the control circuit board 9 controls the scanning speed of the carriage 14 so that the reflection type optical sensor 8 can securely read bar-codes of the bar-code label 7 fixed on the recording head unit. Then, in Step S2, the CPU 23 reads the environmental temperature detected by the environmental temperature sensor 31. Then, in Step S3, the CPU 23 determines the head driving voltage in accordance with the environmental temperature and the ink discharging efficiency included in the read information of the ink jet head characteristics of the recording head unit 4. Following Step S3, the CPU 23 determines a value of the main scanning speed, in Step S4, in accordance with the number of nozzles and the recording density included in the read information of the ink jet head characteristics of the recording head unit 4. Subsequently, in Step S5, the CPU 23 determines a value of the sub-scanning speed in accordance also with the aforesaid number of nozzles and recording density.

Figure 7:
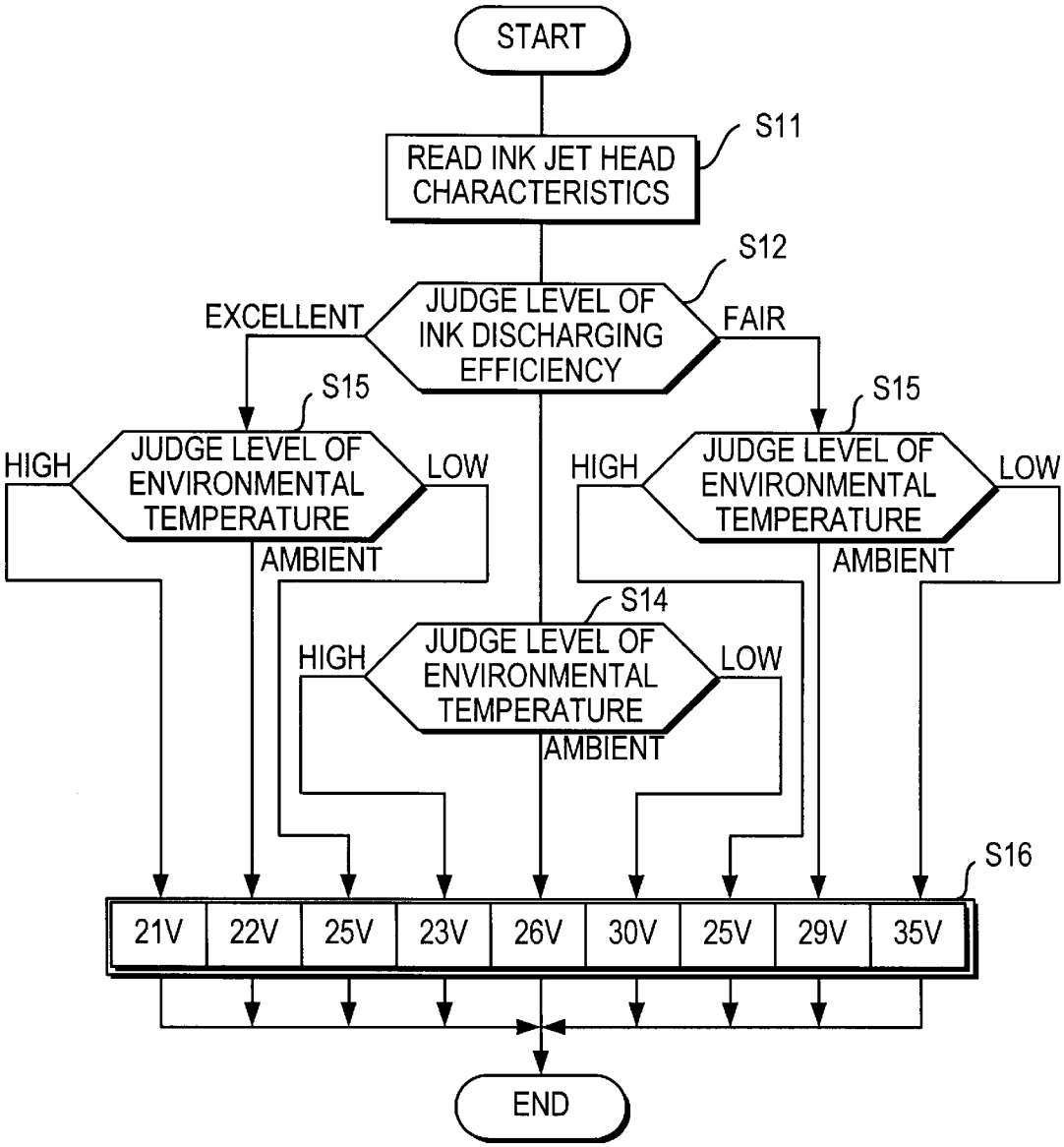
FIG. 7 is a flowchart for explaining how the recording head driving voltage is determined through processes of the flowchart shown in FIG. 6.

Next, the way the CPU 23 determines the head driving voltage during Step S3 of the above-described flowchart is explained with reference to FIG. 7. It is generally known that a higher head driving voltage is needed to maintain a predetermined amount of ink discharging with decreasing degree of ink jet discharging efficiency of the ink jet head unit itself. It is also known that a higher head driving voltage is needed to maintain a predetermined amount of ink discharging with decreasing environmental temperature regardless of ink jet discharging efficiency of the ink jet head unit itself. This is because the degree of overall ink discharging efficiency decreases with decreasing environmental temperature since the consistency of the ink becomes more viscous and the stiffness of the ink jet head unit becomes higher when the environmental temperature is low.

On the basis of the above-mentioned relationships between the head driving voltage and the ink discharging efficiency and between the head driving voltage and the environmental temperature, the CPU 23 of the control circuit board 9 determines appropriate head driving voltage. During Step Sil of the flowchart shown in FIG. 7, the CPU 23 reads information of the ink jet head characteristics and then, in Step S12, checks whether the ink jet discharging efficiency of the recording head unit 4 is at an excellent, good, or fair level. When the ink jet discharging efficiency of the recording head unit 4 is at an excellent level and the result of Step S12 is "excellent", the CPU 23 checks whether the environmental temperature is at a "high", "ambient", or "low" level, in Step S13. When the environmental temperature is at a high level and the result of Step S13 is "high", the CPU 23 determines to set the head driving voltage to 21 volts, in Step S16. When the environmental temperature is at an ambient level and the result of Step S13 is "ambient", the CPU 23 determines to set the head driving voltage to 22 volts, in Step S16. When the environmental temperature is at a low level and the result of Step S13 is "low", the CPU 23 determines to set the head driving voltage to 25 volts, in Step S16.

When the ink jet discharging efficiency of the recording head unit 4 is at a good level and the result of Step S12 is "good", the CPU 23 checks whether the environmental temperature is at a "high", "ambient", or "low" level, in Step S14. When the environmental temperature is at a "high" level and the result of Step S14 is "high", the CPU 23 determines to set the head driving voltage to 23 volts, in Step S16. When the environmental temperature is at an "ambient" level and the result of Step S14 is "ambient", the CPU 23 determines to set the head driving voltage to 26 volts, in Step S16. When the environmental temperature is at a "low" level and the result of Step S14 is "low", the CPU 23 determines to set the head driving voltage to 30 volts, in Step S16.

When the ink jet discharging efficiency of the recording head unit 4 is at a fair level and the result of Step S12 is "fair", the CPU 23 checks whether the environmental temperature is at a "high", "ambient", or "low" level, in Step S15. When the environmental temperature is at a "high" level and the result of Step S15 is "high", the CPU 23 determines to set the head driving voltage to 25 volts, in Step S16. When the environmental temperature is at an "ambient" level and the result of Step S15 is "ambient", the CPU 23 determines to set the head driving voltage to 29 volts, in Step S16. When the environmental temperature is at a "low" level and the result of Step S15 is "low", the CPU 23 determines to set the head driving voltage to 35 volts, in Step S16.

In this way, the novel ink jet recording apparatus 2 can maintain an image quality with an appropriate ink discharging level at a predetermined ink discharging efficiency by varying the head driving voltage in accordance with levels of the ink discharging efficiency of the recording head unit and the environmental temperature.

Figure 8:
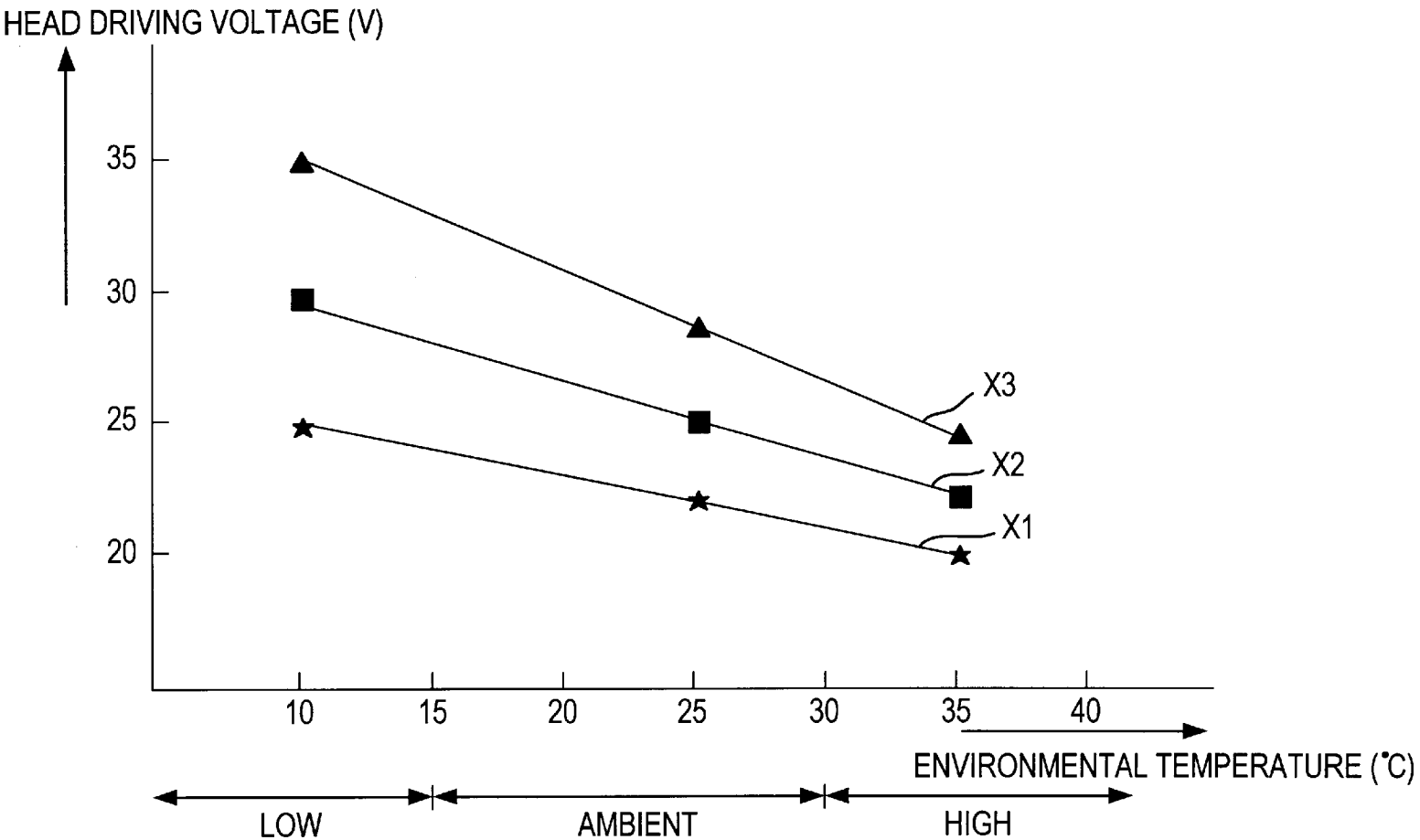
FIG. 8 is a graph illustrating an exemplary relationship among recording head driving voltage, ink discharging efficiency and environmental temperature.

Three stepping levels of both ink discharging efficiency and environmental temperature are described above by way of example, and their relationships with the head driving voltage, which is also described above, are illustrated in FIG. 8. The three lines $X_1$, $X_2$, and $X_3$ shown in FIG. 8 represent three different ink discharging efficiencies, i.e., excellent, good, and fair, respectively. Each of the three lines is made by plotting the respective ink discharging efficiency at temperature varying from low, through ambient, to high. Three star marks at a temperature of, for example, 35° C., 25° C., and 10° C. on the excellent ink discharging efficiency line indicate a head driving voltage of 21, 22, and 25 volts, respectively, as shown in FIG. 7. Three square marks at a temperature of 35° C., 25° C., and 10° C. on the good ink discharging efficiency line indicate a head driving voltage of, for example, 23, 26, and 30 volts, respectively, as shown in FIG. 7. Three triangle marks at a temperature of 35° C., 25° C., and 10° C. on the fair ink discharging efficiency line indicate a head driving voltage of 25, 29, and 35 volts, respectively, as shown in FIG. 7. The number of stepping levels for both ink discharging efficiency and environmental temperature are preferably greater than three in actual use.

Figure 9A:
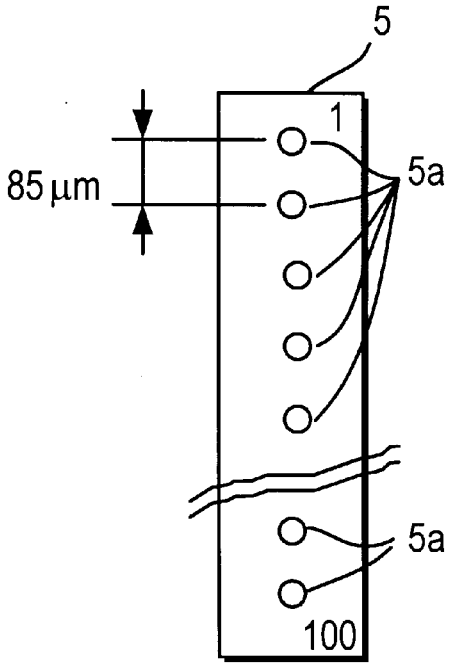
FIGS. 9(*a*) and 9(*b*) are illustrations each showing a plurality of nozzles aligned with a space between each two adjacent nozzles on the surface of the interchangeable recording head unit.
Figure 9B:
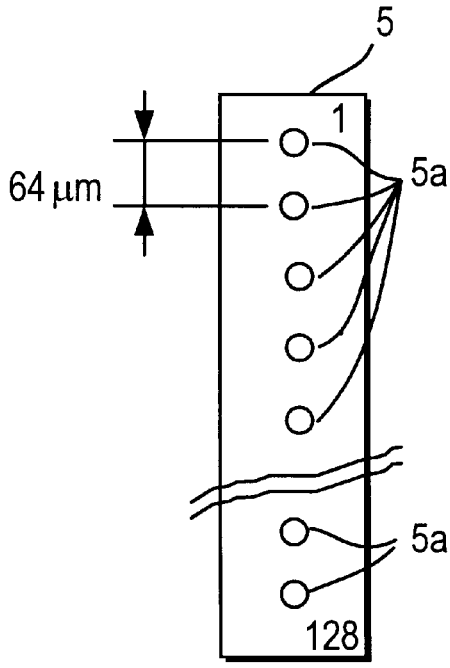

Next, the way the CPU determines spacing between two marking dots in the respective main scanning and sub-scanning directions, is explained with respect to FIGS. 9(*a*)–11.

Generally, it is preferable that a user can select a desired ink jet head unit, to use it on the ink jet recording apparatus 2, among various types of ink jet head units different in characteristics such as image density, for example. More specifically, an example of the ink jet head unit illustrated in FIG. 9(*a*) features a 300-dpi (dot-per-inch) image density. This ink jet head unit includes 100 nozzles, vertically aligned and having a distance of 85-$\mu$m between two nozzles next to each other. Also, another example of the ink jet head unit illustrated in FIG. 9(*b*) features 400-dpi, a higher image density. This ink jet head unit includes 128 nozzles, vertically aligned and having a space of 64-$\mu$m between two nozzles next to each other.

When the ink jet head unit is replaced, the spacing between two marking dots in the main scanning direction and the incremented amount of paper feeding (paper advance) in the sub-scanning direction are respectively required to be changed to fit to the characteristics of the ink jet head.

Figure 10:
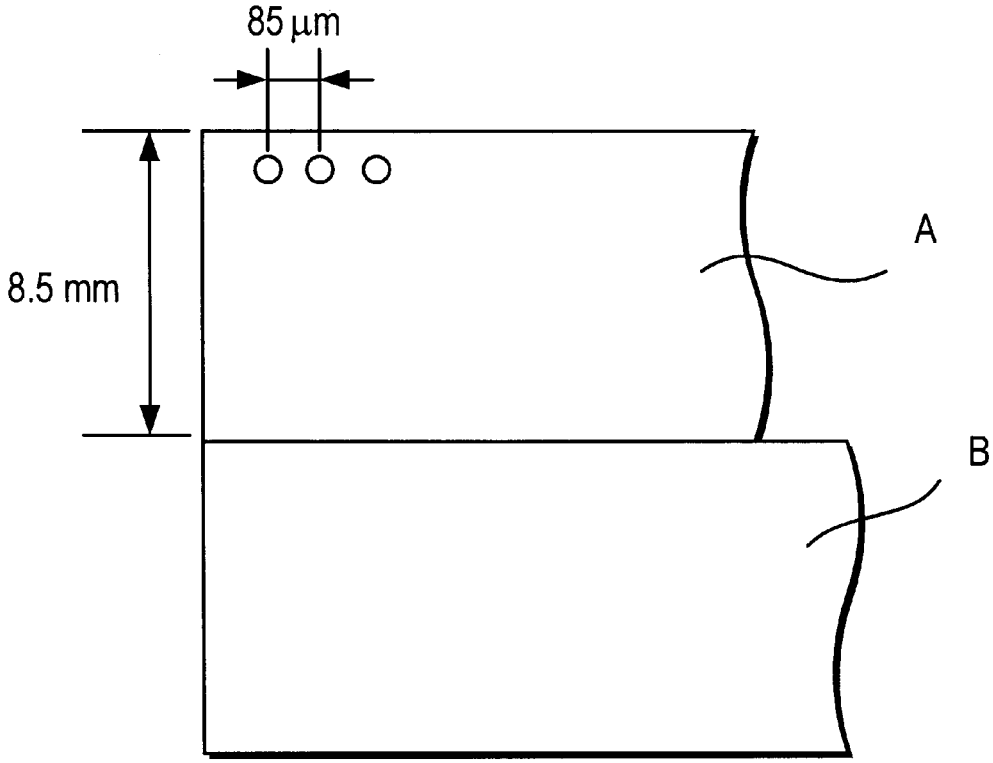
FIGS. 10 and 11 are illustrations each showing an exemplary relationship between the recording density and paper feeding increment.

For example, when the above-mentioned 300-dpi ink jet head unit of FIG. 9(*a*), including 100 nozzles, being vertically aligned and having a space of 85 $\mu$m between two nozzles next to each other, is newly installed to the ink jet recording apparatus 2, the spacing between two adjacent marking dots in the main scanning direction and the incremented amount of paper feeding (advance) in the sub-scanning direction need to be changed. In this case, the spacing between two adjacent marking dots in the main scanning direction is changed to 85 $\mu$m, as shown in FIG. 10. Also, the incremented amount of paper feeding in the sub-scanning direction is changed to 8.5 mm (85-$\mu$m×100), as shown in FIG. 10. An area indicated as A in FIG. 10 is a first scanning area and the following area indicated as B is a second scanning area having a 8.5-mm distance from the first scanning area in the sub-scanning direction.

Figure 11:
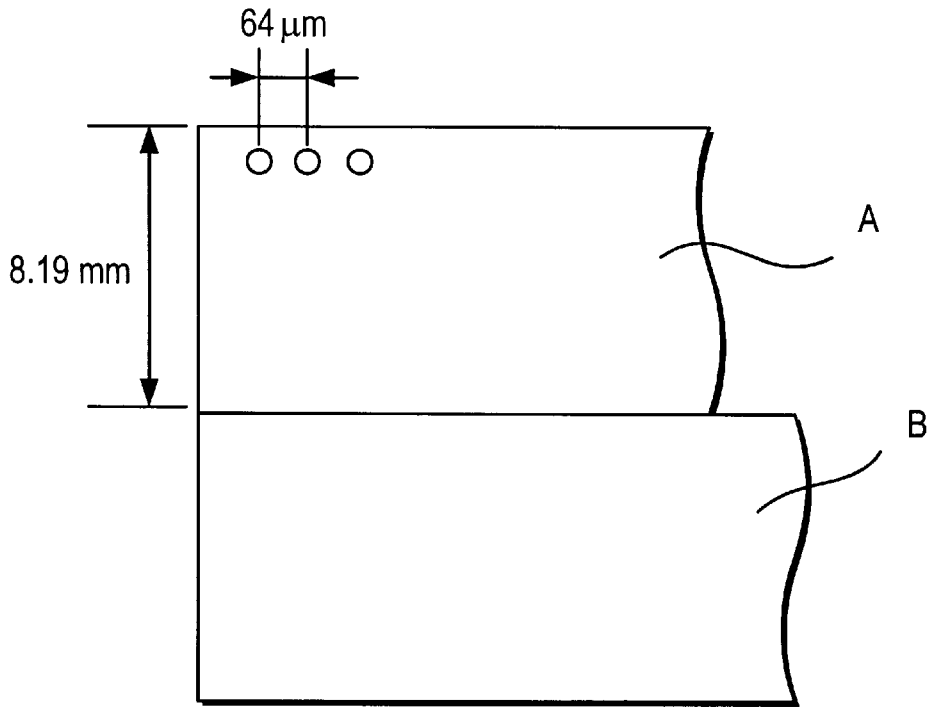

For another example, when the above-mentioned 400-dpi ink jet head unit of FIG. 9(*b*), including 128 nozzles, being vertically aligned and having a space of 64-$\mu$m between two nozzles next to each other, is newly installed to the ink jet recording apparatus 2, the spacing between two adjacent marking dots in the main scanning direction and the incremented amount of paper feeding in the sub-scanning direction need to be changed. In this case, the spacing between two adjacent marking dots in the main scanning direction is changed to 64 $\mu$m, as shown in FIG. 11. Also, the incremented amount of paper feeding in the sub-scanning direction is changed to 8.19 mm (64-$\mu$m×128), as shown in FIG. 11. An area indicated as A in FIG. 11 is a first scanning area and the following area indicated as B is a second scanning area having a 8.19-mm distance from the first scanning area in the sub-scanning direction.

The spacing between two adjacent marking dots in the main scanning direction can be varied by changing the scanning speed of the carriage 14. The spacing may become wider or narrower with increasing or decreasing scanning speed of the carriage 14, respectively. Also, by changing the driving frequency of the piezoelectric element of the ink jet head unit 5 on the recording head unit 4, the spacing between two adjacent marking dots in the main scanning direction can be varied. In this case, the spacing may become wider or narrower with decreasing or increasing driving frequency of the piezoelectric element, respectively. These techniques may be used individually or in combination.

The incremented amount of paper feeding in the sub-scanning direction can be varied by controlling the movement of platen 22.

As mentioned above, the ink jet recording apparatus is capable of detecting information of ink jet head characteristics of each recording head unit, which function is achieved by including an information retaining plate, on an exterior surface of the recording head unit, for retaining the information of the ink jet head characteristics of the recording head unit. As a result, information of ink jet head characteristics, such as, ink discharging efficiency, number of nozzles, recording density, and so forth, can be provided to the ink jet recording apparatus without having a complex and costly structure of the ink jet recording apparatus. Specifically, when a bar-code label, for example, is applied to the information retaining plate as described above, such information of ink jet head characteristics can be provided to the ink jet recording apparatus in an extremely simple and inexpensive manner.

Furthermore, the ink jet recording apparatus is enabled to automatically change a mode of printing operation to a newly installed ink jet head unit, so as to keep a superior image quality with different types of ink jet head units, by having the above-mentioned information retaining plate, an information reading unit, and a condition setup controller for setting a mode of printing operation in accordance with the read information. In this way, a user can avoid the need to change a mode of printing operation by her or himself or by asking a technician to change a mode of printing operation each time an ink head unit is exchanged.

Next, a modified embodiment of the novel ink jet recording apparatus is explained with reference to FIGS. 12–14, in which a modified recording head unit 104, a modified information retaining plate 107, and a modified information reading unit 108 are illustrated, respectively.

Figure 12:
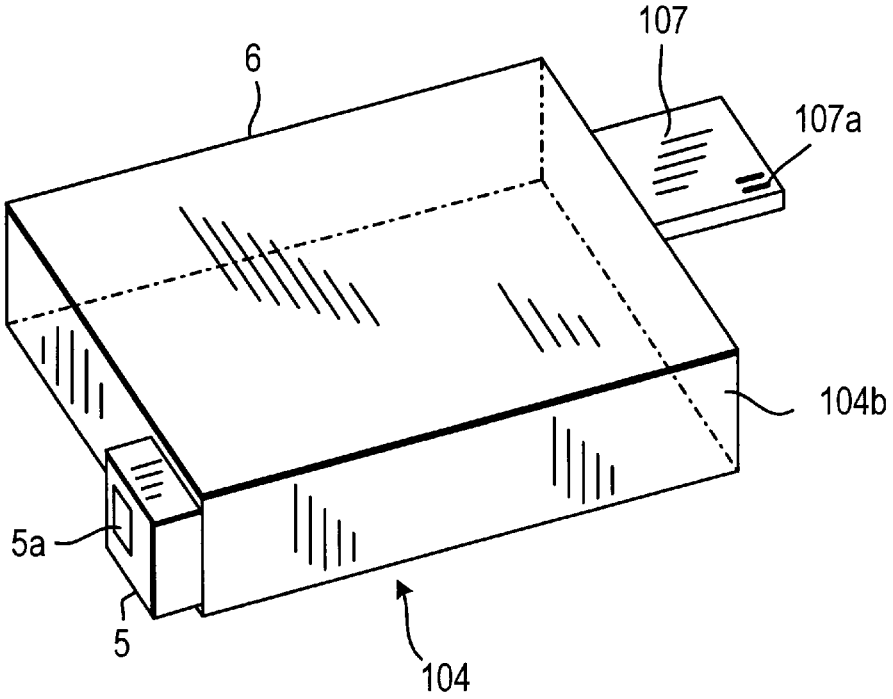
FIG. 12 is a schematic perspective view of a modified interchangeable recording head unit according to the present invention.

As shown in FIG. 12, the modified recording head unit 104 includes the information retaining plate 107 on a rear-side exterior surface 104*b* of the modified recording head unit 104. The information retaining plate 107 may be fixed onto an exterior surface of the recording head unit 104, or molded integrally with the exterior surface of the recording head unit 104. The information retaining plate 107 can be made of a plastic, a metal, or so forth, but is not limited to a certain material. The information retaining plate 107 retains information of the ink jet head characteristics, such as, ink discharging efficiency, number of nozzles, recording density, and so forth. As shown in FIG. 13, the information retaining plate 107 achieves this information retaining function by forming apertures such as notches or pinholes 107*a* at an edge thereof and making various combinations of these pinholes 107*a* in accordance with the information to be retained.

The modified ink jet recording apparatus includes a photoelectric aperture (pinhole) detector 108, as shown in FIG. 14, for detecting pinholes 107*a* formed on an information retaining plate 107 of a recording head unit 104, to read information of ink jet head characteristics of the recording head unit 104.

By employing a plate with pinholes rather than a label with bar-codes, the novel ink jet recording apparatus can avoid a potential misreading of information of the ink jet head characteristics that might occur when a deposit of ink or the like is formed on a region where the information is retained.

Next, an explanation is made of how the novel ink jet recording apparatus 2 reads information of the ink jet head characteristics in the case of using a plurality of recording head units, with reference to FIG. 15. FIG. 15 shows an exemplary set of four recording head units, i.e., 4Y, 4M, 4C, and 4K for containing and discharging yellow, magenta, cyan, and black ink, respectively. The four recording head units are set aligned in a main scanning direction on the carriage 14, so that the reflection type optical sensor 8 can successively read bar-codes of the bar-code labels 7 of all four of the recording head units 4K, 4C, 4M, and 4Y when the carriage 14 performs a main scanning operation in the direction M. In this way, the novel ink jet recording apparatus 2 reads information of the ink jet head characteristics when using a plurality of recording head units.

The above-mentioned novel ink jet recording apparatus 2 is provided with at least one of the interchangeable recording head units each having, for example, a bar-code label or an information retaining plate including pinholes for providing ink jet head characteristic information to the novel ink jet recording apparatus 2. Instead of having the bar-code label or information retaining plate, the recording head unit may be provided with another form of machine-readable array of indicia, such as a label including alphanumeric symbols, representing ink jet head characteristic information. Further, instead of having these bar-code label or information retaining plate, the recording head unit may be provided with a direct print of the ink jet head characteristic information on a surface thereof.

As set forth hereinabove, the novel ink jet recording apparatus 2 can read information of ink jet head characteristics so as to automatically set a mode of printing operation in accordance with the read information each time a recording head unit is replaced. In addition to such a function, the above-mentioned novel ink jet recording apparatus 2 may be capable of sending the read information of the ink jet head characteristics to the host 1 when a recording head unit is replaced. By this function, the host 1 can efficiently perform various data processing, such as, for example, image processing, recording density change processing, and so forth, in order to fit to the newly installed recording head unit including, for example, a different number of nozzles, different image density, and so forth, prior to a process of transferring print data to the ink jet recording apparatus 2. As a result, the ink jet recording apparatus 2 can avoid performing various data processing so as to save a performance time.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations of the present invention are possible in light of the above teachings. It is therefore to be understood that within the scope of the appended claims, the present invention may be practiced otherwise than as specifically described herein.

This application is based on Japanese Patent application JPAP08-136953 filed in the Japanese Patent Office on May 30, 1996. The entire content of that Japanese Patent application is hereby incorporated by reference.

What we claim is:

1. An ink jet recording apparatus comprising:

a plurality of interchangeable recording head units;

each of said interchangeable recording head units having an exterior and including information retaining means, mounted on a part of said exterior, for retaining information of recording characteristics of the interchangeable recording head unit on which it is mounted;

reading means for reading said information of said recording characteristics of said interchangeable recording head units retained by the information retaining means mounted thereon; and a controller including means for instructing said reading means to read said information retaining means and means for performing, in accordance with said information of said recording characteristics of said interchangeable recording head units read by said reading means, at least one function for setting a mode of recording operation and transmitting data, wherein said plurality of interchangeable recording head units are operable at one time on said ink let recording apparatus, and wherein said reading means reads information of recording characteristics of each of said plurality of interchangeable recording head units during a single scanning operation, said information being retained by said information retaining means of each of said plurality of interchangeable recording head units.

2. The ink jet recording apparatus according to claim 1, wherein each information retaining means mounted on a part of the exterior of a corresponding one of said interchangeable recording head units is a bar-code label having a plurality of bar-codes which represent said information of said recording characteristics of the corresponding one of the interchangeable recording head units, and wherein said reading means is a reflection type optical sensor.

3. The ink jet recording apparatus according to claim 2, further comprising an environmental temperature detecting means for detecting an environmental temperature, and wherein said control means includes setup means for setting conditions for driving an actuating element of each interchangable recording head unit, by using information of ink discharging efficiency retained by said information retaining means of each interchangeable recording head unit and said environmental temperature detected by said environmental temperature detecting means.

4. The ink jet recording apparatus according to claim 3, wherein said control means includes setup means for setting at least one of a carriage moving speed and a paper transferring speed by using information of number of ink jet nozzles and recording density retained by said information retaining means of each interchangeable recording head unit.

5. The ink jet recording apparatus according to claim 2, wherein said control means includes setup means for setting at least one of a carriage moving speed and a paper transferring speed by using information of number of ink jet nozzles and recording density retained by the information retaining means of each of said interchangeable recording head units.

6. The ink jet recording apparatus according to claim 1, wherein each information retaining means mounted on a part of the exterior of a corresponding one of said interchangeable recording head units is a plate-shaped member having a plurality of apertures which represent said information of said recording characteristics of the corresponding one of the interchangeable recording head units, and wherein said reading means is a photoelectric aperture detector.

7. The ink jet recording apparatus according to claim 6, further comprising an environmental temperature detecting means for detecting an environmental temperature, and wherein said control means includes setup means for setting conditions for driving an actuating element of each interchangable recording head unit, by using information of ink discharging efficiency retained by said information retaining means of each interchangeable recording head unit and said environmental temperature detected by said environmental temperature detecting means.

8. The ink jet recording apparatus according to claim 7, wherein said control means includes setup means for setting at least one of a carriage moving speed and a paper transferring speed by using information of number of ink jet nozzles and recording density retained by said information retaining means of each interchangeable recording head unit.

9. The ink jet recording apparatus according to claim 6, wherein said control means includes setup means for setting at least one of a carriage moving speed and a paper transferring speed by using information of number of ink jet nozzles and recording density retained by the information retaining means of each of said interchangeable recording head units.

10. The ink jet recording apparatus according to claim 1, further comprising an environmental temperature detecting means for detecting an environmental temperature, and wherein said control means includes setup means for setting conditions for driving an actuating element of each interchangable recording head unit, by using information of ink discharging efficiency retained by said information retaining means of each interchangable recording head unit and said environmental temperature detected by said environmental temprature detecting means.

11. The ink jet recording apparatus according to claim 10, wherein said control means includes setup means for setting at least one of a carriage moving speed and a paper transferring speed by using information of number of ink jet nozzles and recording density retained by said information retaining means of each interchangeable recording head unit.

12. The ink jet recording apparatus according to claim 1, wherein said control means includes setup means for setting at least one of a carriage moving speed and a paper transferring speed by using information of number of ink jet nozzles and recording density retained by the information retaining means of each of said interchangeable recording head units.

13. An ink jet recording apparatus comprising:

a plurality of interchangeable recording head units;

each of said interchangeable recording head units having an exterior and including an information retainer, mounted on a part of said exterior, for retaining information of recording characteristics of the interchangeable recording head unit on which it is mounted;

an optical sensor for reading said information of said recording characteristics of said interchangeable recording head units retained by the information retainers; and a controller for instructing the optical sensor to read an information retainer when at least one of said interchangeable recording head units is replaced and for performing, in accordance with said information of said recording characteristics of said interchangeable recording head units read by said optical sensor, at least one function for setting a mode of recording operation and transmitting data, wherein said plurality of interchangeable recording head units are operable at one time on said ink jet recording apparatus, and wherein said optical sensor reads information of recording characteristics of each of said interchangeable recording head units during a single scanning operation, said information being retained by the information retainer of each of said plurality of interchangeable recording head units.

14. The ink jet recording apparatus according to claim 13, wherein each information retainer mounted on a part of the exterior of a corresponding one of said interchangeable recording head units is a bar-code label having a plurality of bar-codes which represent said information of said recording characteristics of the corresponding one of the interchangeable recording head units, and wherein said optical sensor is a reflection type optical sensor.

15. The ink jet recording apparatus according to claim 14, further comprising an environmental temperature detector for detecting an environmental temperature, and wherein said controller includes a setup manager for setting conditions for driving an actuating element of each interchangable recording head unit, by using information of ink discharging efficiency retained by said information retainer of each interchangeable recording head unit and said environmental temperature detected by said environmental temperature detector.

16. The ink jet recording apparatus according to claim 15, wherein said controller includes a setup manager for setting at least one of a carriage moving speed and an incremental amount of paper advance by using information of number of ink jet nozzles and recording density retained by said information retainer of each interchangeable recording head unit.

17. The ink jet recording apparatus according to claim 14, wherein said controller includes a setup manager for setting at least one of a carriage moving speed and an incremental amount of paper advance by using information of number of ink jet nozzles and recording density retained by the information retainer of each of said interchangeable recording head units.

18. The ink jet recording apparatus according to claim 13, wherein each information retainer mounted on a part of the exterior of a corresponding one of said interchangeable recording head units is a plate-shaped member having a plurality of apertures which represent said information of said recording characteristics of the corresponding one of the interchangeable recording head units, and wherein the optical sensor is a photoelectric aperture detector.

19. The ink jet recording apparatus according to claim 18, further comprising an environmental temperature detector for detecting an environmental temperature, and wherein said controller includes a setup manager for setting conditions for driving an actuating element of each interchangable recording head unit, by using information of ink discharging efficiency retained by said information retainer of each interchangeable recording head unit and said environmental temperature detected by said environmental temperature detector.

20. The ink jet recording apparatus according to claim 19, wherein said controller includes a setup manager for setting at least one of a carriage moving speed and an incremental amount of paper advance by using information of number of ink jet nozzles and recording density retained by said information retainer of each interchangeable recording head unit.

21. The ink jet recording apparatus according to claim 18, wherein said controller includes a setup manager for setting at least one of a carriage moving speed and an incremental amount of paper advance by using information of number of ink jet nozzles and recording density retained by the information retainer of each of said interchangeable recording head units.

22. The ink jet recording apparatus according to claim 13, further comprising an environmental temperature detector for detecting an environmental temperature, and wherein said controller includes a setup manager for setting conditions for driving an actuating element of each interchangable recording head unit, by using information of ink discharging efficiency retained by said information retainer of each interchangeable recording head unit and said environmental temperature detected by said environmental temperature detector.

23. The ink jet recording apparatus according to claim 22, wherein said controller includes a setup manager for setting at least one of a carriage moving speed and an incremental amount of paper advance by using information of number of ink jet nozzles and recording density retained by said information retainer of each interchangeable recording head unit.

24. The ink jet recording apparatus according to claim 13, wherein said controller includes a setup manager for setting at least one of a carriage moving speed and an incremental amount of paper advance by using information of number of ink jet nozzles and recording density retained by the information retainer of each of said interchangeable recording head units.

* * * * *